US007568352B2

(12) United States Patent
Grayson et al.

(10) Patent No.: US 7,568,352 B2
(45) Date of Patent: Aug. 4, 2009

(54) THERMALLY COUPLED LIQUID OXYGEN AND LIQUID METHANE STORAGE VESSEL

(75) Inventors: Gary D. Grayson, Huntington Beach, CA (US); Michael L. Hand, Huntington Beach, CA (US); Edwin C. Cady, Tustin, CA (US)

(73) Assignee: The Boeing Company, Chicago, IL (US)

( * ) Notice: Subject to any disclaimer, the term of this patent is extended or adjusted under 35 U.S.C. 154(b) by 373 days.

(21) Appl. No.: 11/359,853

(22) Filed: Feb. 22, 2006

(65) Prior Publication Data

US 2007/0193282 A1 Aug. 23, 2007

(51) Int. Cl.
*F17C 3/08* (2006.01)
*F17C 7/02* (2006.01)

(52) U.S. Cl. ..... 62/45.1; 62/50.1

(58) Field of Classification Search ..... 62/45.1, 62/48.3, 50.1

See application file for complete search history.

(56) References Cited

U.S. PATENT DOCUMENTS 2,863,297 A * 12/1958 Johnston ..... 62/45.1
2,871,669 A * 2/1959 Mann et al. ..... 62/48.3
3,030,780 A * 4/1962 Loveday ..... 62/48.3
3,136,121 A * 6/1964 Barger et al. ..... 60/259
3,807,396 A * 4/1974 Fischel ..... 128/201.21
3,877,240 A * 4/1975 Kniel et al. ..... 62/48.2
5,005,362 A * 4/1991 Weltmer et al. ..... 62/45.1
5,568,901 A * 10/1996 Stiennon ..... 244/63
5,901,557 A 5/1999 Grayson
5,960,633 A * 10/1999 Limbach ..... 62/45.1
6,453,680 B1 * 9/2002 Allen ..... 62/45.1
2002/0116931 A1 * 8/2002 Lak et al. ..... 62/45.1

OTHER PUBLICATIONS

Grayson, "Propellant Trade Study for a Crew Space Vehicle," The Boeing Company, AIAA 2005-4313, 41st AIAA/ASME/SAE/ASEE Joint Propulsion Conf. and Exhibit, Jul. 2005, pp. 1-16.

* cited by examiner

*Primary Examiner*—William C Doerrler
(74) *Attorney, Agent, or Firm*—Canady & Lortz LLP; Bradley K. Lortz

(57) ABSTRACT

A cryogenic propellant storage tank system and method are disclosed that thermally couple LO2 and LCH4 tanks together by using either a single tank compartmentalized by a common tank wall or two separate tanks that are coupled together with one or more thermal couplers having high thermal conductivity. Cryogenic cooling equipment may be located only in the LO2 tank while the LCH4 is cooled by the LO2 tank interface. Embodiments of the invention may employ both LO2 and LCH4 liquid acquisition devices (LADs) for low-gravity use. In further embodiments, only the LO2 LADs may be integrated with thermal cooling equipment.

19 Claims, 8 Drawing Sheets

THERMALLY COUPLED LIQUID OXYGEN AND LIQUID METHANE STORAGE VESSEL

BACKGROUND OF THE INVENTION

1. Field of the Invention

This invention relates to fluid propellant propulsion systems and methods. Particularly, this invention relates to such propulsion systems and methods in space applications.

2. Description of the Related Art

A variety of liquid propellant systems have been proposed and developed to drive rockets and space vehicles. In most liquid propellant rocket engines, a fuel and an oxidizer, e.g. kerosene and liquid oxygen (LO2) are pumped into a combustion chamber where they burn to yield a high pressure and high velocity gas stream. The flow of the gas through a nozzle accelerates it further until it exits the engine. The exiting gas provides thrust in the opposite direction which is used to accelerate or maneuver the vehicle.

In many space vehicles it is typical for the fuel and/or the oxidizer to be a cryogenic liquefied gas such as liquid hydrogen or LO2. A common problem in a liquid propellant rocket engine is cooling the combustion chamber and nozzle. Accordingly, the cryogenic liquids are often circulated around the super-heated parts in order to cool them. The pumps must generate extremely high pressures to overcome the pressure that the burning fuel creates in the combustion chamber.

Many different combinations of fuel and oxidizer have been used in liquid propellant rocket engines. For example, gasoline and liquid oxygen were used in early rockets of Goddard. Kerosene and LO2 were used in the first stage of the large Saturn V boosters in the Apollo program. Liquid hydrogen and LO2 are currently used in the Space Shuttle main engines. And nitrogen tetroxide and monomethyl hydrazine were used in the Cassini mission to Saturn.

Recently, there has been interest in propulsion employing a combination of LO2 and liquid methane (LCH4). The bipropellant of LO2 and LCH4 has recently been selected by NASA as a possible fuel for the Crew Exploration Vehicle (CEV) and future space exploration. A fundamental physical problem in developing a propulsion system employing this bipropellant is storing the cryogenic LO2 and liquid methane (LCH4) with the least amount of boil-off due to heating and with the least amount of mass and power required. Another problem is providing a means to drain single-phase liquid from the storage tank without an entrained gas phase. In addition, the system must maintain the storage tank within a specified pressure and temperature range while the gravitational environment varies from zero-gravity to accelerations much larger than Earth's normal gravity.

Because both fluids are cryogenic, typical thermal environments on Earth and in space will cause the propellants to warm and tend to boil within the tanks. As the pressure nears the structural limits of the tank, it must be reduced, either by venting or some other means. Limiting the amount of heat flow into the tanks prolongs the lifetime of the cryogenic liquid because boil-off and the associated pressure increase is directly related to the amount of energy flow into the storage vessel. An active refrigeration system or cryocooler can be employed to intercept the external heat flow and maintain the tanks at sufficiently cold temperatures. However, such cryocoolers require relatively high electric power and generally operate continuously. For spacecraft and other energy limited applications, large power consuming systems are undesirable.

Other more passive techniques that condition the fluids without the energy consumption of a cryocooler are known, but they typically operate with less cooling performance. However, for applications without long lifetimes, a passive thermal solution may be a better solution. In such passive systems, foam and multilayer insulations have been used as well as low-conductivity structural supports and vapor-cooled shields. For applications where tank mass is less critical, a dual wall container can be used with an evacuated cavity to minimize wall heat flow.

Another challenge in developing an oxygen and methane bipropellant system involves the draining of liquid tanks in low-gravity or highly dynamic acceleration environments to acquire a single phase liquid. Draining liquid from a tank on Earth or in steady elevated acceleration fields is performed by simply placing an outlet at the bottom of the tank. However, in low gravity, with no significant gravity field to pull it to one side of the tank, the specific liquid location within the tank is generally not known at all times because the liquid can easily move about the tank. To deal with this problem, special liquid acquisition devices (LADs), which operate based on the surface tension properties of the fluid, are often employed to address the low-gravity liquid dynamics.

For example, U.S. Pat. No. 5,901,557, issued May 11, 1999 to Grayson, which is incorporated by reference herein, discloses a vessel storing cryogenic fluid having a passive thermodynamic venting system for effectively and reliably transferring heat in a reduced-gravity environment. The storage vessel has a storage tank for holding the cryogenic fluid under pressure. The storage vessel is compartmentalized using a screen trap so that the heat exchanger of the venting system extends through a compartment which includes only the liquid phase of the cryogenic fluid. A screen gallery, screen trap and vane assembly cooperate to separate the gas and the liquid phases of the cryogenic fluid. The thermodynamic venting system includes a throttle device for reducing the temperature of cryogenic fluid. A conduit in contact with heat exchange elements transfers heat from the liquid phase of the cryogenic fluid to a relief valve for venting the heat external of the storage tank.

Grayson, "Propellant Trade Study for a Crew Space Vehicle", AIAA 2005-4313,41st AIAA/ASME/SAE/ASEE Joint Propulsion Conference and Exhibit 10-13 Jul. 2005, Tucson, Ariz., which is incorporated by reference herein, discloses a trade study to determine the best propellant combination for a notional crew space vehicle. The assumed 5000 ft/s spacecraft is divided into a command module and service module like Apollo and provides transportation of astronauts and supplies to low Earth orbit, the International Space Station, libration point one, and one-way transfer from lunar orbit to Earth. Twenty-five different propellant combinations are evaluated across nine important evaluation criteria that include mass, development, safety, complexity, reliability, flexibility, contamination, commonality, and Mars in-situ producibility. Nontoxic and Mars-producible are decided to be important requirements for an affordable Earth-moon-Mars exploration architecture. The assumptions when coupled with a mathematical model to estimate vehicle wet mass, lead to the recommendation of liquid oxygen and liquid methane for orbital maneuvering and gaseous oxygen with gaseous methane for reaction control. The new propellant combinations require up-front investment that includes new or modified engines, ground infrastructure, long term cryogenic storage technology, and, for the later occupation of Mars, in-situ production of methane and oxygen for propulsion.

In a conventional storage system applied to LO2 and LCH4 bipropellant, the liquids are stored in separate tanks with separate thermal conditioning hardware. In this case, each tank requires separate insulation, thermodynamic vent, vapor-cooled shields, and separate cryocoolers (for long duration storage). In such separate, thermally independent tanks, each fluid is typically stored at its normal boiling point in one atmosphere of pressure which is about 162° R for LO2 and 201° R for LCH4. Thus, a conventional solution requires more insulation due to larger tank external surface area and additional thermal conditioning hardware. This results in a higher total mass of the tanks and the associated thermal conditioning hardware.

In view of the foregoing, there is a need in the art for systems and methods for cryogenic storage of liquid propulsion constituents which require less mass. There is also a need for such systems and methods to operate more efficiently, operating with significantly lower power requirements. Particularly, there is a need for such systems and methods for LO2 and LCH4 bipropellant systems. As detailed hereafter, these and other needs are satisfied by embodiments of the present invention.

SUMMARY OF THE INVENTION

A typical embodiment of the invention comprises a first tank comprising a first liquid propellant, a second tank comprising a second liquid propellant, and a thermal coupler between the first tank and the second tank for transferring heat energy between the first tank and the second tank to substantially maintain the first liquid propellant and the second liquid propellant at a substantially similar temperature. In one exemplary embodiment, the first liquid propellant comprises liquid oxygen (LO2) and the second liquid propellant comprises liquid methane (LCH4). Further, the liquid oxygen (LO2) and the liquid methane (LCH4) may be maintained at the substantially similar temperature of 164° R.

In general, the thermal coupler may be implemented in one of two alternate structures. In some embodiments of the invention, the thermal coupler may comprise a common tank wall between the first tank and the second tank. In other embodiments of the invention, the thermal coupler may comprise one or more metal bands coupling the first tank to the second tank. However, it should also be noted that those skilled in the art may combine a common tank wall with additional thermal coupling bands depending upon the particular tank configuration.

In further embodiments of the invention, the first tank and the second tank may each comprise a liquid acquisition device (LAD) for acquiring the first liquid propellant and the second liquid propellant as single phase liquids from the first tank and the second tank, respectively. In one notable embodiment, the common tank wall between the first tank and the second tank forms a crevasse in the second tank and a liquid acquisition device (LAD) of the second tank is disposed in the crevasse. The LAD of the second tank comprises a plurality of vanes coupled to the common tank wall and supporting a LAD channel. In addition to supporting the LAD channel, the vanes can act as cooling fins to the second propellant of the second tank.

Thermally coupling the tanks in accordance with the invention enables the elimination or reduction of structure and systems that would otherwise be duplicated in conventional implementation. For example, in some embodiments, only the first tank includes a thermodynamic vent system to directly cool the first tank and the second tank is cooled through the thermal coupler between the first tank and the second tank. In a similar manner, for some embodiments, only the first tank provides vapor to a vapor cooled shield surrounding both the first tank and the second tank. Similarly, in some embodiments only the outer surface of the first tank and the second tank combined are thermally shielded with no thermal shielding between the first tank and the second tank.

Similarly, a typical method embodiment of the invention comprises the operations of filling a first tank with a first liquid propellant, filling a second tank comprising a second liquid propellant, and transferring heat energy between the first tank and the second tank to substantially maintain the first liquid propellant and the second liquid propellant at a substantially similar temperature with a thermal coupler disposed between the first tank and the second tank. In addition, the method embodiment of the invention may be further modified consistent with the apparatus embodiments described throughout.

BRIEF DESCRIPTION OF THE DRAWINGS

Referring now to the drawings in which like reference numbers represent corresponding parts throughout.

DETAILED DESCRIPTION OF THE PREFERRED EMBODIMENT

1. Overview

LO2 and LCH4 have relatively similar boiling temperatures on Earth; oxygen boils at 162° R while methane boils at 201° R. At a temperature near 164° R both fluids can exist in liquid phase if they are stored in tanks with the appropriate pressures. This allows the fluids to be thermally coupled, and thus stored at the same temperature which leads to several benefits. Although the invention described herein may be discussed with reference to the combination of LO2 and LCH4, those skilled in the art will understand that embodiments of the invention may be more broadly applied to other bipropellant combinations, provided a substantially similar functional operating temperature can be determined for the proposed bipropellant.

In various embodiments of the invention a cryogenic propellant storage tank system and method are disclosed that thermally couple LO2 and LCH4 tanks together by using either a single tank compartmentalized by a common tank wall or two separate tanks that are coupled together with one or more thermal couplers having high thermal conductivities. Cryogenic cooling equipment may be located only in the LO2 tank while the LCH4 is cooled by the LO2 tank interface. Embodiments of the invention may employ both LO2 and LCH4 liquid acquisition devices (LADs) for low-gravity use. However, the tanks can also operate in Earth gravities and higher as well. In further embodiments, only the LO2 LADs may be integrated with additional thermal cooling equipment.

Embodiments of the invention can reduce the amount of LO2 and LCH4 that boil within a tank (called boil-off) while being stored in an environment with temperatures above the LO2 and LCH4 boiling points. When tank pressure increases to a preselected maximum, embodiments of the invention can reduce the pressure thermally, without significant loss of fluid. Embodiments of the invention also allow liquid phase fluids to be drained from the tanks in lieu of gaseous phase fluids in acceleration environments ranging from zero-gravity to high gravity that is many times that at the Earth's surface. Note that thermal coupling is not possible for fluids with large differences in liquid temperature range. For example LO2 and LH2 can not be thermally coupled because the LO2 would freeze.

The integrated LO2 and LCH4 tank system and method of the present invention provides a low-mass, low-power propellant tank option for the Crew Exploration Vehicle (CEV) and future LO2/LCH4 powered vehicles such as lunar or planetary landers, ascent vehicles, propellant tankers, in-space depots, and transfer stages.

Embodiments of the invention can provide reduced system mass and volume, reduced boil-off, tank pressure control, and liquid acquisition through a combination of features.

2. Thermally Coupled Bipropellant Fuel Tanks

Figure 1:
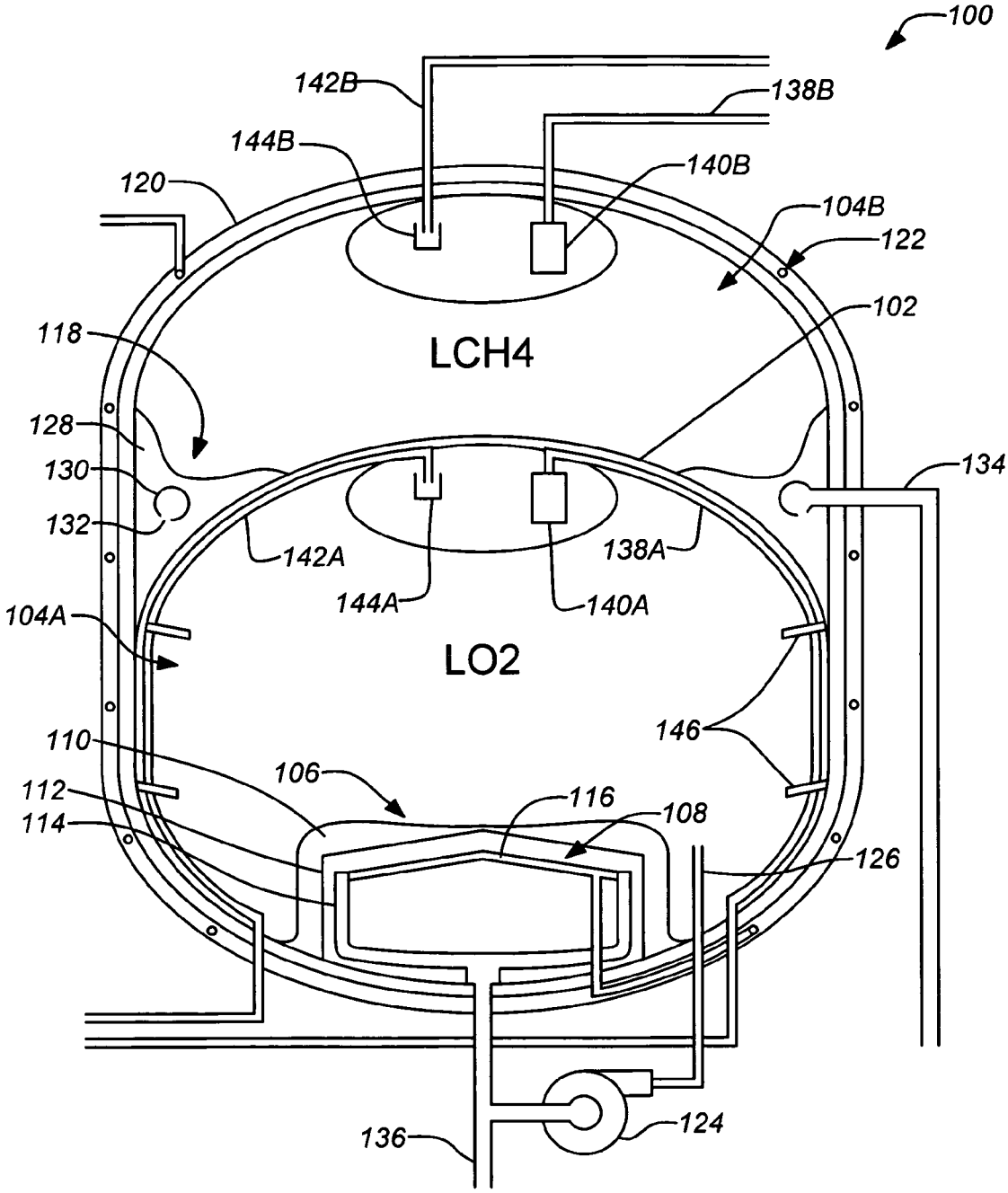
FIG. 1 is cross section illustrating an exemplary embodiment of the invention employing both LO2 and LCH4 within a single tank that subdivided by a common tank wall.

FIG. 1 is cross section illustrating an exemplary embodiment of the invention employing both LO2 and LCH4 within of a single bipropellant tank 100 that is subdivided by a common tank wall 102 to act as a thermal coupler between the two tanks 104A, 104B. The bipropellant tank 100 is substantially cylindrical with rounded ends. The common tank wall 102 has a concave shape to provide more volume within the tank 100 apportioned to the LO2 tank 104A on the bottom. It should be noted that other shapes for the common tank wall are possible, but this configuration allows for a functional crevasse within the LCH4 tank 104B for the LCH4 LAD 118 as described below. The common tank wall 102 is uninsulated and thermally conductive to enable heat transfer between the two liquid tanks 104A, 104B. The LO2 tank 104A includes a liquid acquisition device (LAD) 106 integrated with a thermodynamic vent system (TVS) 108 similar to that taught in U.S. Pat. No. 5,901,557. The LAD 106 includes multi-function vanes 110 (e.g. twenty vanes disposed in a radial arrangement from the tank center) for heat transfer and liquid acquisition, a screen trap 112, and screen LAD channels 114 (e.g. four channels within the screen trap 112). The TVS lines 116 originate within the LAD channels 114 and are fixed to the channels 114. The TVS lines 116 run along the LAD channels 114 to cool them and then exit the LO2 tank 104A.

In typical embodiments of the present invention, the line from the LO2 TVS 108 may be repeatedly routed around the tank 100 exterior attached to a thin high thermal conductivity shield (e.g. formed from a metal) that surrounds the tank 100 to function as a vapor cooled shield (VCS) 122. The VCS 122 and associated lines from the LO2 TVS 108 may be sandwiched between layers of multi-layer insulation (MLI) 120 that surround the tank 100. For example, the MLI layers may comprise very thin (e.g. 0.25 mil) mylar sheets, aluminized on both sides and sandwiched between spacers (e.g. Dacron netting) and the thin high thermal conductivity shield may comprise an approximately 10 mil thick aluminum sheet sandwiched within the MLI layers.

A separate mixer pump 124 may also be included for the LO2 tank 104A (at the LO2 engine outlet 136) in order to provide mixing within the LO2 with a return LO2 mixing outlet 126 into the LO2 tank 104A. In contrast, the LCH4 tank 104B may dispense with a mixing pump and operate with only a LAD 118 since it receives sufficient cooling through the common tank wall 102 from the LO2 tank 104A. The pump 124 is depicted external to the tank 100 but may also be located internally in other embodiments.

The LCH4 LAD 118 is conveniently disposed in a crevasse formed between the common tank wall 102 and LCH4 tank 104B outer cylindrical wall. This novel LAD 118 configuration comprises a plurality of vanes 128 (e.g. twelve vanes disposed in a radial arrangement from the tank center) around the periphery of the LCH4 tank 104B. The crevasse serves as a natural collecting channel for LCH4. Typically, the vanes 128 are flat shaped pieces of high conductivity material (e.g. metal). These vanes 128 function to further wick liquid into the crevasse of the LCH4 tank 104B in addition to the effect of the compartment shape. The vanes 128 are shaped such that the profile of the plan-form surface of each vane 128 is curved to present "fingers" that extend upward along the LCH4 cylindrical wall and along the common tank wall 102. Holes are also disposed in each LCH4 vane 128 to allow an annular LAD channel 130 to be installed through the holes circumferentially around the LCH4 tank 104B within the crevasse. The annular LAD channel 130 has holes or slots 132 at each vane location directed toward the bottom of the LCH4 tank 104B crevasse. The annular LAD channel 130 exits the LCH4 tank 104B through the outer cylindrical wall as the LCH4 outlet 134.

Both tanks 104A, 104B also include pressurization lines 138A, 138B with flow diffusers 140A, 140B, respectively, that deliver pressurant gas (e.g. Helium) to the tops of the tanks 104A, 104B. Similarly, both tanks 104A, 104B also include vent lines 142A, 142B with vent baffles 144A, 144B attached to the ends internal to the tanks 104A, 104B. Additionally, slosh baffles 146, known in the art, may be present in either tank (although only depicted in the LO2 tank 104A) in order to assist controlling liquid motion. As shown, the LO2 tank 104A employs two baffles 146 circumferentially around the upper and lower areas of the tank 104A.

Embodiments of the invention may be employed in any space vehicle, such as a lunar lander currently being developed. A typical embodiment may employ 100 layers of MLI, a single VCS, and a loaded mixture ratio of 3.5:1, assuming a boil-off rate of approximately 1%-3% per month.

In any specific implementation, the optimal LAD channel dimensions, screen material, vane number, insulation required, TVS/VCS flow rates, and pipe diameters may be determined through typical design and test processes known to those skilled in the art. Each cryogenic tank may be designed for a specific mission and/or vehicle, so imposed requirements will determine the optimal design for a particular application.

Embodiments of the invention reduce the total tank surface area that must be insulated over conventional separate tank designs which require complete insulation over each separate tank of fuel and oxidizer. This low-surface area approach to insulating the cryogenic fluids is achieved by either a single tank that is compartmentalized with a common tank wall or by separate tanks that are nested together or adjacent to one another. In any case, only the outer surface of the overall tank configuration area requires insulation; there is no thermal shielding required between the tanks. Thus, both a common tank wall configuration and a nested separate tank configuration obtain reduced insulation surface area. Furthermore, reducing the outside surface area also decreases the heat leak into the tank, further reducing the temperature rise and associated tank pressure increase.

Embodiments of the invention also operate both the LO2 and LCH4 near a common temperature such that both fluids are kept in liquid states. In a conventional configuration, these fluids would be stored separately and at different temperatures. For example, one functional operating temperature is 164° R at 1 atmosphere of pressure where the LCH4 is liquid near freezing and the LO2 is a slightly superheated liquid. The optimal common temperature for a particular embodiment of the invention will depend upon the specific tank configuration and the selected tank pressures. Accordingly, many temperature operating points will work. Also, by using one liquid near freezing, a "built-in" energy margin for tank pressure rise exists since the vapor pressure is reduced.

A common tank wall or high thermal conductivity connections between tanks provide the thermal coupling between the liquids such that heat can easily flow between the separate compartments or tanks. This enables use of only a single cooling system to be operated from the vapor of only one of the tanks (e.g. the VCS 122 from the LO2 tank in the embodiment of FIG. 1). The other cryogenic fluid (e.g. LCH4) may be sufficiently cooled through the common wall and shared cooling system output. For example, at 1 atmosphere of pressure LO2 is normally stored at a colder temperature than LCH4, e.g. 162° R compared to 201° R, respectively. For this reason, the LO2 is closer to boiling than the LCH4, and so the cooling hardware is optimally located within the LO2 tank. Furthermore, the LO2 has a larger thermal mass than the LCH4 resulting in smaller temperature changes for a given heat leak into the LO2 than LCH4 when operated near the same temperatures; the LO2 temperature is less sensitive to heat leaks than the LCH4 temperature. Thus, the LO2 acts as a heat sink for the LCH4, essentially inhibiting boil-off within the LCH4 tank.

In some embodiments, the LCH4 LAD can be implemented within a crevasse formed by the common tank wall and LCH4 cylindrical tank wall, e.g. the convex common tank wall 102 as shown in the exemplary embodiment of FIG. 1. The narrowing channel towards the bottom of the LCH4 tank provides an advantageous shape for liquid acquisition. Since the crevasse narrows towards the tank bottom, liquid adherence to the tank surface is improved in that area. Due to this advantageous shape only vanes and a single LAD channel are needed within an LCH4 tank in such a configuration.

Furthermore, the vanes used in the LCH4 liquid acquisition design can also act as cooling fins for the LCH4. The vanes may be anchored to the common tank wall (or adjacent tank surface in separate tank configurations) so the base of each vane is substantially maintained at the LO2 tank temperature. Thus, the LCH4 tank vanes are multi-purpose, providing both liquid acquisition and LCH4 cooling from an external source (i.e. the LO2 tank).

In addition, the single LAD channel in the LCH4 tank in some embodiments can comprise a simple tube with downward facing slots or holes that draw the liquid from the intersection of the LCH4 compartment crevasse and vanes. The slots or holes straddle the vanes so that each vane cuts across the entrance to the hole or slot in the LAD.

LCH4 liquid acquisition is aided by surface tension gradients that exist in the tank due to the thermal coupling design. Since the common tank wall with the LO2 is colder than the LCH4 tank outer walls, a temperature gradient will exist across the LCH4 tank. The LCH4 LAD channel can thus be advantageously located near the cold section (as it is in the preferred embodiment). Gas bubbles will tend to move towards the warmer surfaces due to the surface tension gradients that form as a result of the temperature gradients. Thus, liquid will tend to flow towards the cold side of the tank where the LAD is located.

As previously mentioned, the LO2 tanks may employ a LAD with an integrated TVS similar to that taught in U.S. Pat. No. 5,901,557. However, other integrated LAD/TVS designs may be used as will be understood by those skilled in the art. A VCS is not required but may improve performance by intercepting heat before it flows into the tank. Further embodiments of the invention may employ known vent and pressurization systems as necessary. Any known means for removing gas while in normal or high gravity and any known means for injecting pressurant into each tank may be used. The slosh baffles shown in the exemplary embodiment of FIG. 1 are typical for a launch vehicle tank.

3. Alternate Thermally Coupled Bipropellant Tank Configurations

FIGS. 2A-2K illustrate eleven cross-sections of alternate tank configurations that can employ thermal coupling in accordance with the present invention. As shall be understood by those skilled in the art, the detailed structure in the exemplary embodiment of FIG. 1 may be adapted to each of the configurations of FIGS. 2A-2K.

Figure 2A:
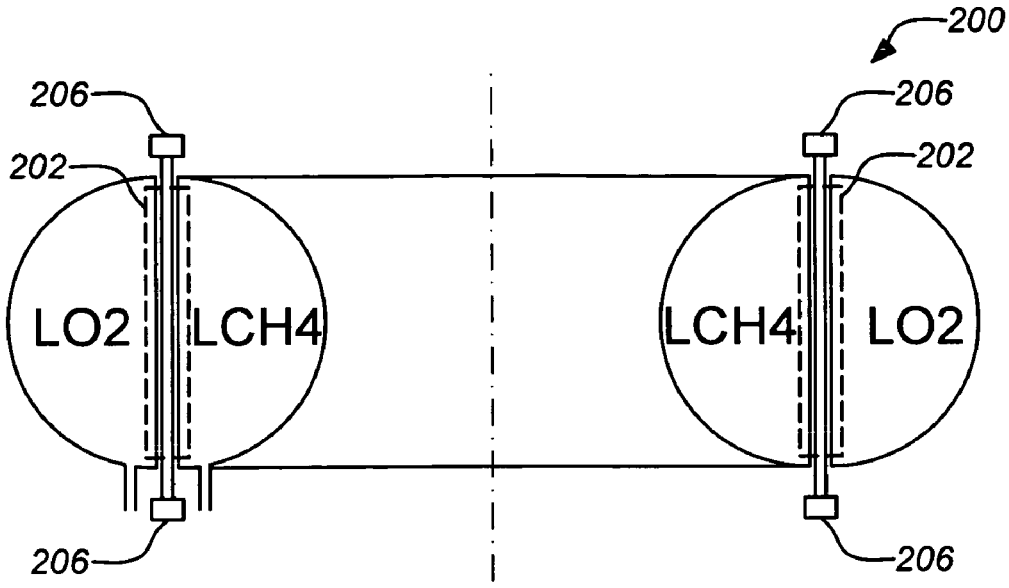
FIG. 2A illustrates an alternate embodiment of the invention employing a toroidal tank subdivided by a common vertical tank wall.
Figure 2B:
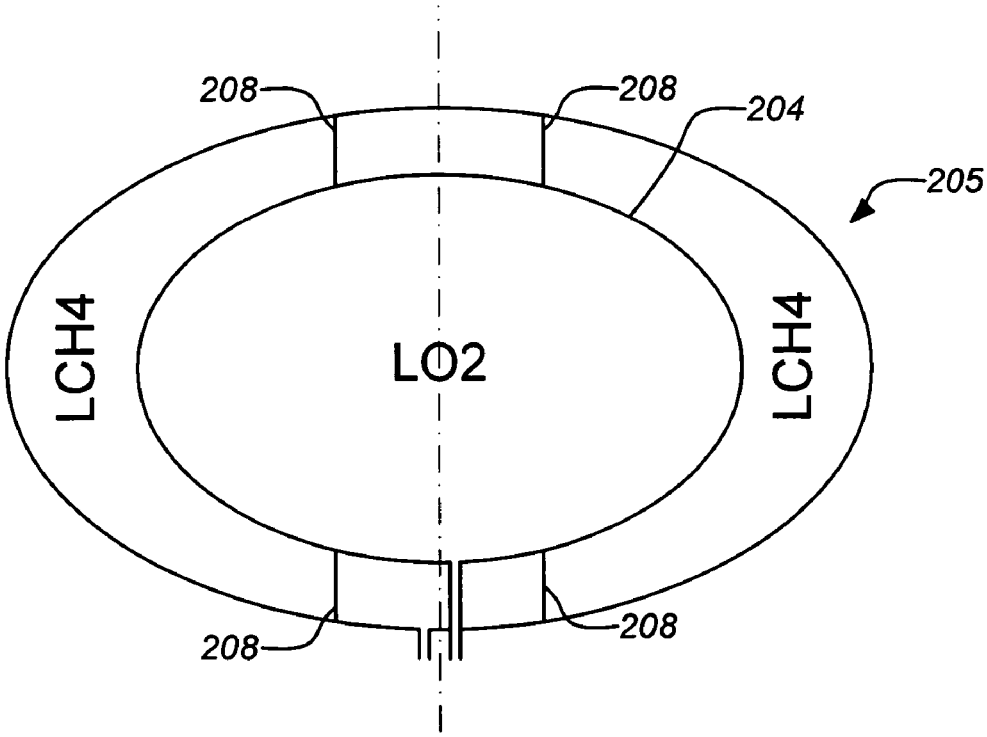
FIG. 2B illustrates an alternate embodiment of the invention employing an ellipsoidal LO2 tank enclosed within an ellipsoidal LCH4 tank.
Figure 2C:
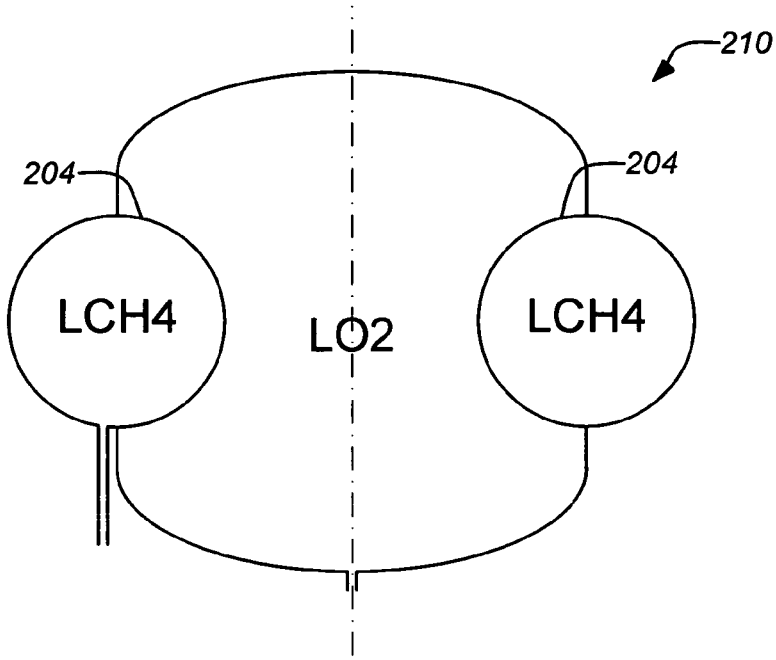
FIG. 2C illustrates an alternate embodiment of the invention employing a toroidal LCH4 tank partially embedded within a LO2 tank.
Figure 2D:
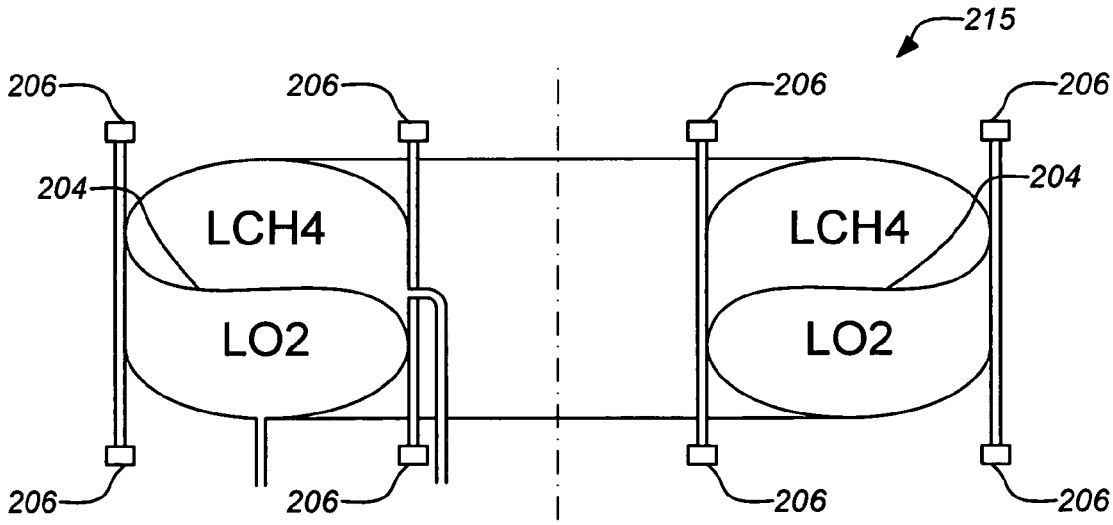
FIG. 2D illustrates an alternate embodiment of the invention employing a toroidal tank subdivided by a common substantially horizontal tank wall.
Figure 2E:
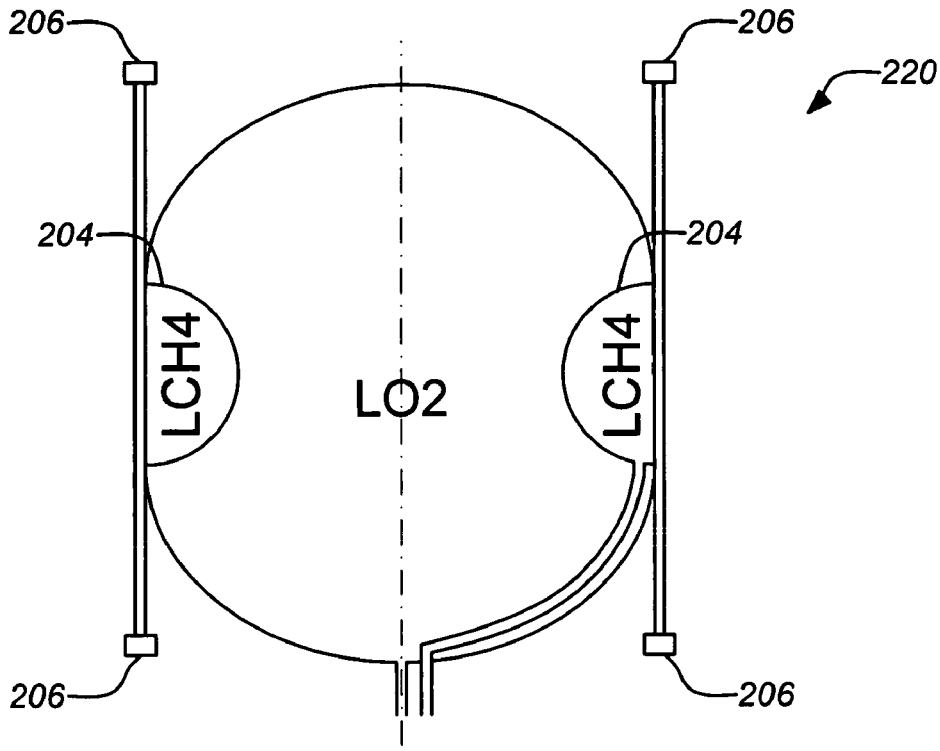
FIG. 2E illustrates an alternate embodiment of the invention employing a semi-toroidal LCH4 tank entirely embedded within a LO2 tank.
Figure 2F:
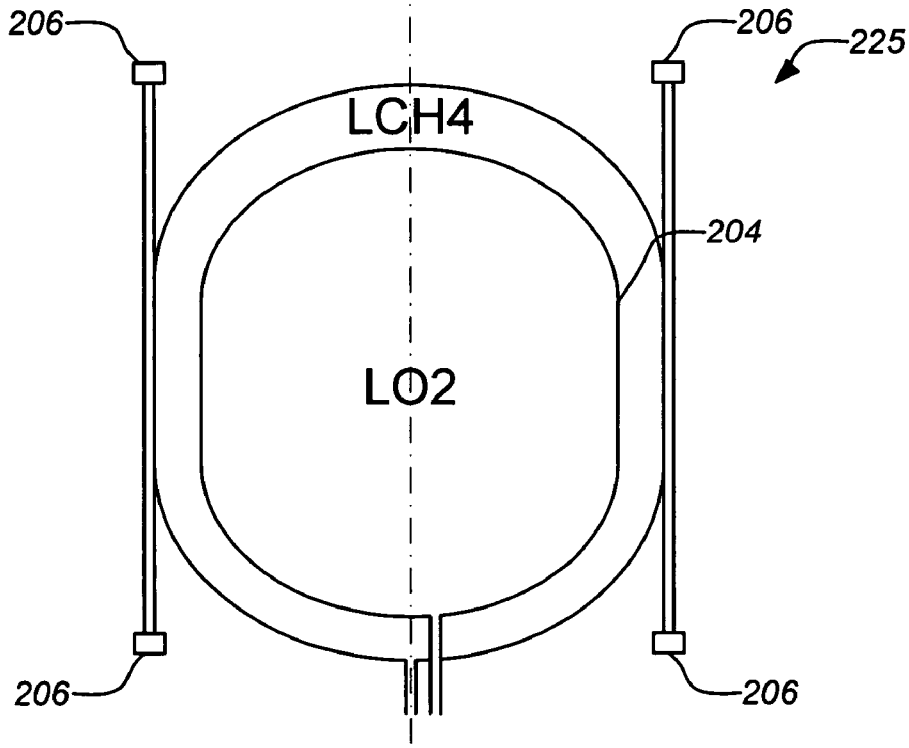
FIG. 2F illustrates an alternate embodiment of the invention employing a cylindrical LO2 tank enclosed within a cylindrical LCH4 tank.
Figure 2G:
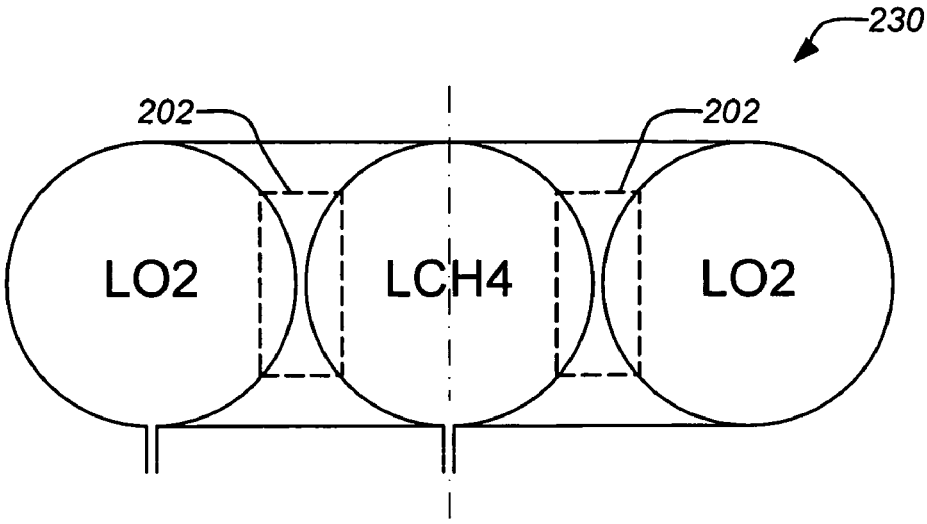
FIG. 2G illustrates an alternate embodiment of the invention employing a toroidal LO2 tank encircling a spherical LCH4 tank.
Figure 2H:
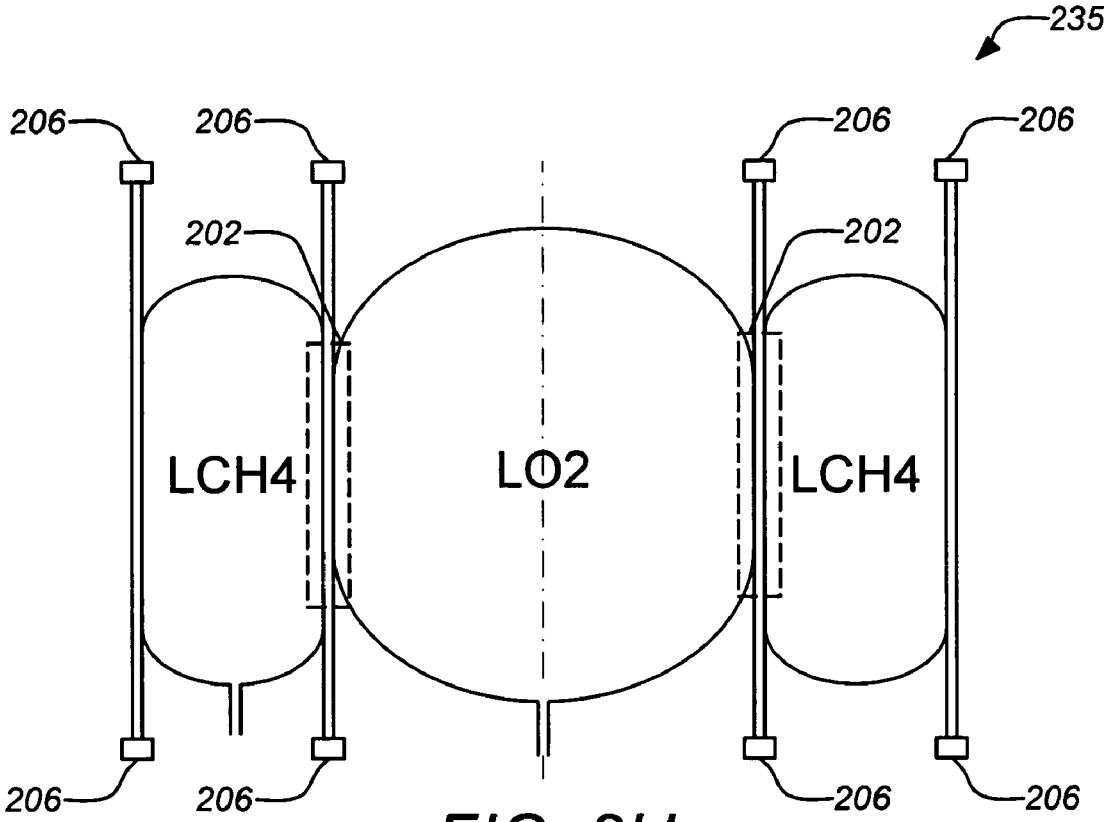
FIG. 2H illustrates an alternate embodiment of the invention employing a tall toroidal LCH4 tank encircling a cylindrical LO2 tank having a common tank wall.
Figure 2I:
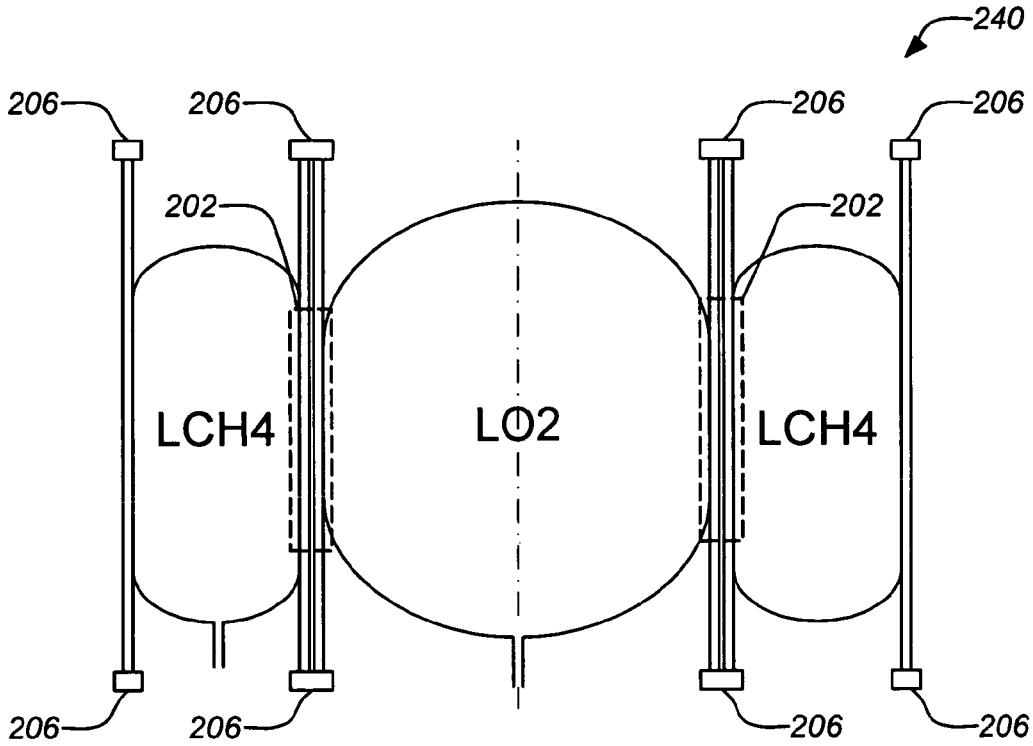
FIG. 2I illustrates an alternate embodiment of the invention employing a tall toroidal LCH4 tank encircling a cylindrical LO2 tank with separate tank walls.
Figure 2J:
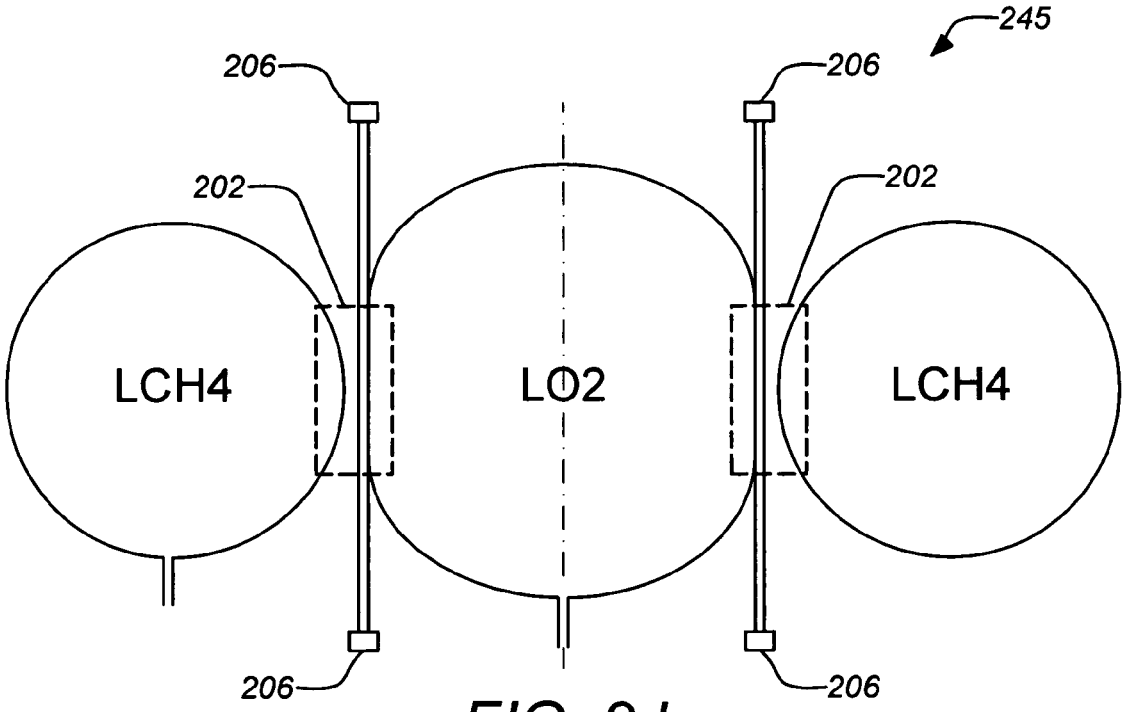
FIG. 2J illustrates an alternate embodiment of the invention employing a toroidal LCH4 tank encircling a cylindrical LO2 tank.
Figure 2K:
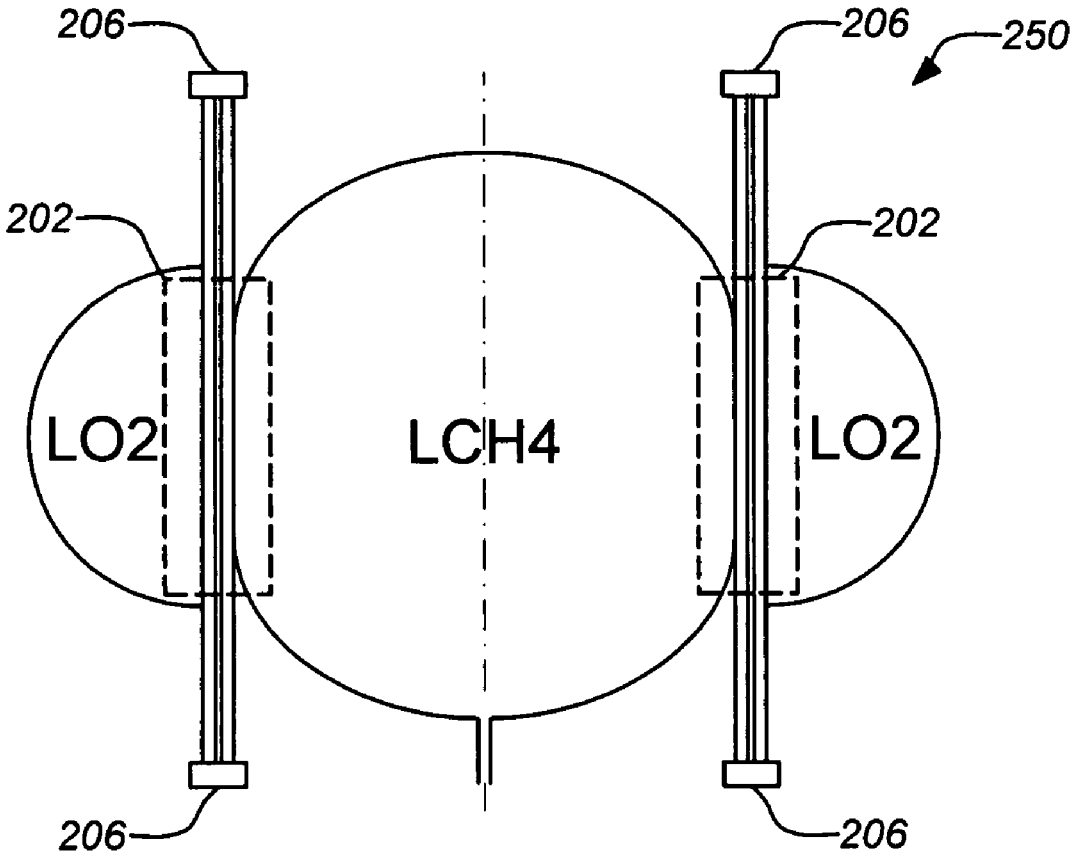
FIG. 2K illustrates an alternate embodiment of the invention employing a semi-toroidal LO2 tank encircling a cylindrical LCH4 tank.

FIG. 2A illustrates an alternate embodiment of the invention employing a bipropellant tank configuration 200 where a toroidal tank is subdivided by a common vertical tank wall. FIG. 2B illustrates an alternate embodiment of the invention employing a bipropellant tank configuration 205 where an ellipsoidal LO2 tank enclosed within an ellipsoidal LCH4 tank. In this case, standoffs 208 are used to support the LO2 tank within the LCH4 tank. FIG. 2C illustrates an alternate embodiment of the invention employing a bipropellant tank configuration 210 where a toroidal LCH4 tank is partially embedded within a LO2 tank. FIG. 2D illustrates an alternate embodiment of the invention employing a bipropellant tank configuration 215 where a toroidal tank is subdivided by a common substantially horizontal tank wall. FIG. 2E illustrates an alternate embodiment of the invention employing a bipropellant tank configuration 220 where a semi-toroidal LCH4 tank is entirely embedded within a LO2 tank. FIG. 2F illustrates an alternate embodiment of the invention employing a bipropellant tank configuration 225 where a cylindrical LO2 tank is enclosed within a cylindrical LCH4 tank. FIG. 2G illustrates an alternate embodiment of the invention employing a bipropellant tank configuration 230 where a toroidal LO2 tank encircles a spherical LCH4 tank. FIG. 2H illustrates an alternate embodiment of the invention employing a bipropellant tank configuration 235 where a tall toroidal LCH4 tank encircles a cylindrical LO2 tank having a common tank wall. FIG. 21 illustrates an alternate embodiment of the invention employing a bipropellant tank configuration 240 where a tall toroidal LCH4 tank encircles a cylindrical LO2 tank with separate tank walls. FIG. 2J illustrates an alternate embodiment of the invention employing a bipropellant tank configuration 245 where a toroidal LCH4 tank encircles a cylindrical LO2 tank. FIG. 2K illustrates an alternate embodiment of the invention employing a bipropellant tank configuration 250 where a semi-toroidal LO2 tank encircles a cylindrical LCH4 tank with separate tank walls.

Some of the configurations utilize completely separate tanks, such as configurations 200, 230, 235, 240, 245 and 250, that can employ cylindrical, ellipsoidal, spherical, or toroidal shaped tanks. In each of these configurations 200, 230, 235, 240, 245 and 250 the separate tanks are closely adjacent (and typically nested within each other) to provide improved thermal coupling surface between the separate tanks and to reduce the outside surface area (reducing external heat paths). These configurations 200, 230, 235, 240, 245 and 250 employ thermal couplers 202 (indicated by the dashed area) such as one or more metal straps or any other suitable thermal conductor affixed between the separate tanks providing high heat transfer between the LO2 and LCH4. The metal straps may be somewhat flexible to accommodate movement and/or structural distortion between the separate tanks.

Other configurations utilize tanks with a common tank wall 204 separating the LO2 and LCH4 tanks such as configurations 100, 205, 210, 215, 220 and 225. The commonly-walled tanks may be either load-bearing or non-load-bearing. As is known in the art, a load-bearing tank accommodates an axial load (vertical with respect to the configurations shown in FIGS. 1, 2A-2K) which is carried through the tank wall or integral structural supports as shown. The cylindrical sections depicted by caps 206 at the ends in some of the configurations indicate a load-bearing configuration. Any of the configurations 100, 205-250 can be employed in an embodiment of the invention. The relative merits of each will depend upon the requirements of the particular application; some may be lighter, cheaper, or perform better than others as determined through a full development process.

4. Method of Thermally Coupling Bipropellant Fuel Tanks

Figure 3:
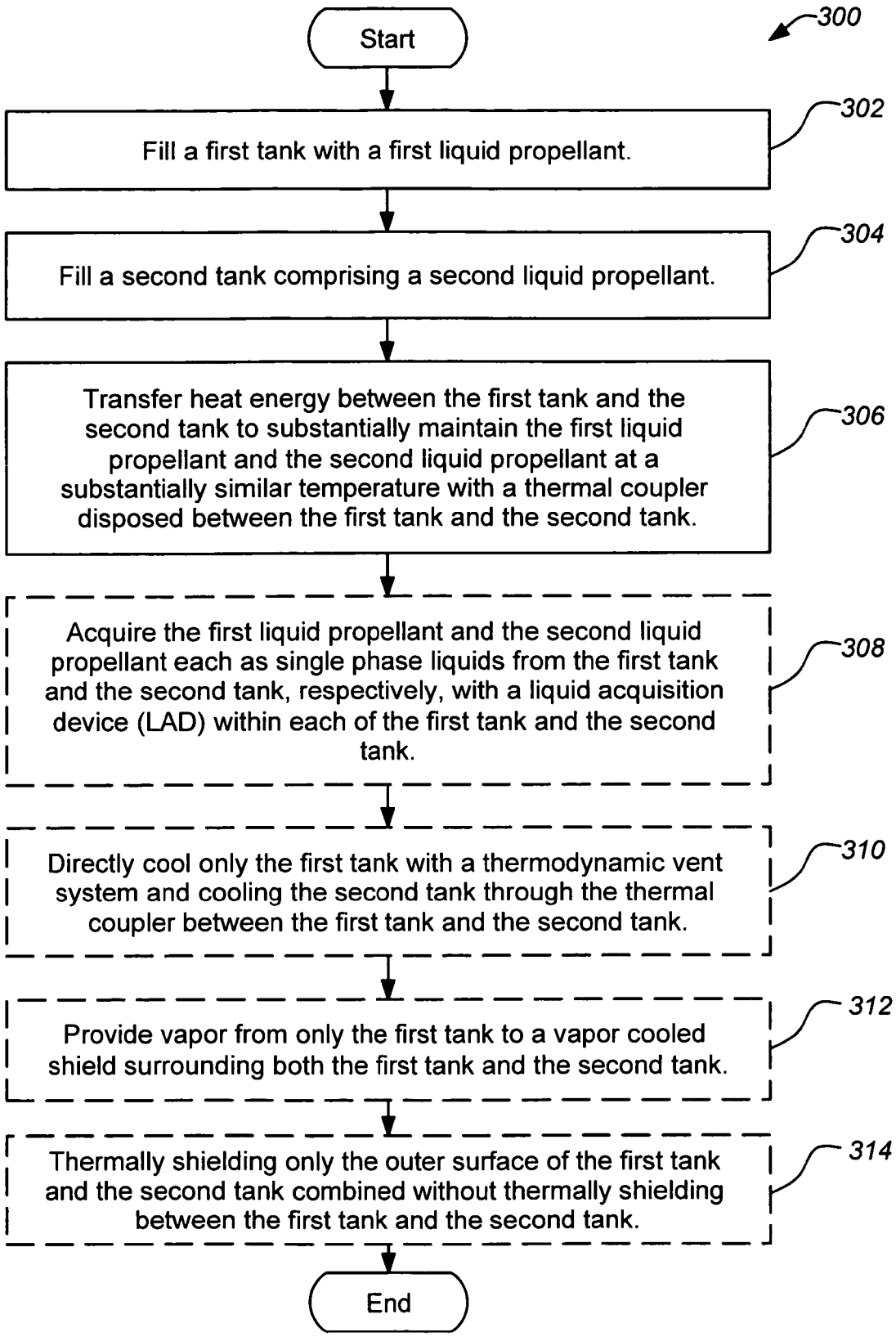
FIG. 3 is a flowchart of a method of thermally coupling bipropellant tanks.

FIG. 3 is a flowchart of a method 300 of thermally coupling bipropellant tanks. The basic method 300 begins with an operation of filling a first tank with a first liquid propellant at block 302. Next, a second tank comprising a second liquid propellant is filled at block 304. Finally, at block 306, heat energy is transferred between the second tank and the first tank to substantially maintain the first liquid propellant and the second liquid propellant at a substantially similar temperature with a thermal coupler disposed between the first tank and the second tank. The basic method 300 may be further modified consistent with the apparatus embodiments previously described. For example, typically the first liquid propellant comprises liquid oxygen (LO2) and the second liquid propellant comprises liquid methane (LCH4) and the liquid oxygen (LO2) and the liquid methane (LCH4) may be substantially maintained at the substantially similar temperature of 164° R.

In addition, optional operations may be performed with the basic method 300, as indicated by the dotted outlines. In the optional operation of block 308, the first liquid propellant and the second liquid propellant are each acquired as single phase liquids from the first tank and the second tank, respectively, with a liquid acquisition device (LAD) within each of the first tank and the second tank. In the optional operation of block 310, only the first tank is directly cooled with a thermodynamic vent system and cooling the second tank is through the thermal coupler between the first tank and the second tank. In block 312, vapor is provided from only the first tank to a vapor cooled shield surrounding both the first tank and the second tank. Finally, in the optional operation of block 314, only the outer surface of the first tank and the second tank combined are thermally shielded without thermally shielding between the first tank and the second tank.

This concludes the description including the preferred embodiments of the present invention. The foregoing description including the preferred embodiment of the invention has been presented for the purposes of illustration and description. It is not intended to be exhaustive or to limit the invention to the precise forms disclosed. Many modifications and variations are possible within the scope of the foregoing teachings. Additional variations of the present invention may be devised without departing from the inventive concept as set forth in the following claims.

What is claimed is:

1. An apparatus, comprising:

a first tank comprising a first liquid propellant;

a second tank comprising a second liquid propellant; and a thermal couplet between the second tank and the first tank for transferring heat energy between the first tank and the second tank to substantially maintain the first liquid propellant and the second liquid propellant at a substantially similar temperature;

wherein the first tank, the second tank and the thermal coupler are employed in a space vehicle having a propulsion system using the first liquid propellant and the second liquid propellant and wherein the thermal coupler comprises one or more metal bands coupling the first tank to the second tank.

2. The apparatus of claim 1, wherein the first liquid propellant comprises liquid oxygen (LO2) and the second liquid propellant comprises liquid methane (LCH4).

3. The apparatus of claim 2, wherein the liquid oxygen (LO2) and the liquid methane (LCH4) are substantially maintained at the substantially similar temperature of 164° R.

4. The apparatus of claim 1, wherein the first tank and the second tank each comprise a liquid acquisition device (LAD) for acquiring the first liquid propellant and the second liquid propellant as single phase liquids from the first tank and the second tank, respectively.

5. The apparatus of claim 1, wherein only the first tank includes a thermodynamic vent system to directly cool the first tank and the second tank is cooled through the thermal coupler between the first tank and the second tank.

6. The apparatus of claim 1, wherein only the first tank provides vapor to a vapor cooled shield surrounding both the first tank and the second tank.

7. The apparatus of claim 1, wherein only the outer surface of the first tank and the second tank combined are thermally shielded with no thermal shielding between the first tank and the second tank.

8. An apparatus, comprising:

a first tank comprising a first liquid propellant;

a second tank comprising a second liquid propellant; and a thermal coupler between the second tank and the first tank for transferring heat energy between the first tank and the second tank to substantially maintain the first liquid propellant and the second liquid propellant at a substantially similar temperature;

wherein the first tank, the second tank and the thermal coupler are employed in a space vehicle having a propulsion system using the first liquid propellant and the second liquid propellant and wherein the first tank and the second tank each comprise a liquid acquisition device (LAD) for acquiring the first liquid propellant and the second liquid propellant as single phase liquids from the first tank and the second tank, respectively.

9. The apparatus of claim 8, wherein the thermal coupler comprises a common tank wall between the first tank and the second tank.

10. The apparatus of claim 9, wherein the common tank wall between the first tank and the second tank forms a crevasse in the second tank and a liquid acquisition device (LAD) of the second tank is disposed in the crevasse, the LAD of the second tank comprising a plurality of vanes coupled to the common tank wall and supporting a LAD channel.

11. A method, comprising:

filling a first tank with a first liquid propellant;

filling a second tank comprising a second liquid propellant; and transferring heat energy between the second tank and the first tank to substantially maintain the first liquid propellant and the second liquid propellant at a substantially similar temperature with a thermal coupler disposed between the first tank and the second tank;

acquiring the first liquid propellant and the second liquid propellant each as single phase liquids from the first tank and the second tank, respectively, with a liquid acquisition device (LAD) within each of the first tank and the second tank;

wherein the first tank, the second tank and the thermal coupler are employed in a space vehicle having a propulsion system using the first liquid propellant and the second liquid propellant.

12. The method of claim 11, wherein the first liquid propellant comprises liquid oxygen (LO2) and the second liquid propellant comprises liquid methane (LCH4).

13. The method of claim 12, wherein the liquid oxygen (LO2) and the liquid methane (LCH4) are substantially maintained at the substantially similar temperature of 164° R.

14. The method of claim 11, further comprising directly cooling only the first tank with a thermodynamic vent system and cooling the second tank through the thermal coupler between the first tank and the second tank.

15. The method of claim 11, further comprising providing vapor from only the first tank to a vapor cooled shield surrounding both the first tank and the second tank.

16. The method of claim 11, further comprising thermally shielding only the outer surface of the first tank and the second tank combined without thermally shielding between the first tank and the second tank.

17. The method of claim 11, wherein the thermal coupler comprises one or more metal bands coupling the first tank to the second tank.

18. The method of claim 11, wherein the thermal coupler comprises a common tank wall between the first tank and the second tank.

19. The method of claim 18, wherein the common tank wall between the first tank and the second tank forms a crevasse in the second tank and a liquid acquisition device (LAD) of the second tank is disposed in the crevasse, the LAD of the second tank comprising a plurality of vanes coupled to the common tank wall and supporting a LAD channel.

* * * * *